US009212595B2

(12) United States Patent
An et al.

(10) Patent No.: US 9,212,595 B2
(45) Date of Patent: Dec. 15, 2015

(54) STRUCTURE OF EXHAUST SYSTEM FOR CDA ENGINE

(71) Applicant: Hyundai Motor Company, Seoul (KR)

(72) Inventors: Ho-Chan An, Hwasung-shi (KR); Chul-Min Park, Seoul (KR); Seung-Hwan Lim, Seoul (KR); Jong-Ho Seon, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/511,491

(22) Filed: Oct. 10, 2014

(65) Prior Publication Data

US 2015/0101885 A1 Apr. 16, 2015

(30) Foreign Application Priority Data

Oct. 15, 2013 (KR) ..... 10-2013-122376

(51) Int. Cl.
*F01N 13/02* (2010.01)
*F01N 1/08* (2006.01)
*F01N 13/08* (2010.01)

(52) U.S. Cl.
CPC ..... *F01N 13/087* (2013.01); *F01N 13/02* (2013.01); *F01N 1/08* (2013.01); *F01N 2240/36* (2013.01)

(58) Field of Classification Search
CPC .... F01N 13/087; F01N 13/02; F01N 2240/36
USPC ..... 181/232, 253, 254
See application file for complete search history.

(56) References Cited

U.S. PATENT DOCUMENTS 4,971,166 A * 11/1990 Hase ..... 181/254

FOREIGN PATENT DOCUMENTS

JP 2001-140627 A 5/2001

* cited by examiner

*Primary Examiner* — Jeremy Luks
(74) *Attorney, Agent, or Firm* — Morgan, Lewis & Bockius LLP

(57) ABSTRACT

A structure of an exhaust system for a cylinder deactivation (CDA) engine may include first, second and third baffles which are coupled in a main muffler, and divide an interior of the main muffler into first, second, third and fourth spaces respectively, a connecting pipe which connects the second space and the third space of the main muffler, and has a passage in which the exhaust gas flows, a first valve coupled to the passage of the connecting pipe to open and close the passage of the connecting pipe, and a second valve openably and closably coupled to the second baffle disposed between the second space and the third space, wherein the first baffle coupled between the first space and the second space, and the third baffle coupled between the third space and the fourth space, have a plurality of holes so that the exhaust gas flows therethrough.

6 Claims, 6 Drawing Sheets

STRUCTURE OF EXHAUST SYSTEM FOR CDA ENGINE

CROSS-REFERENCE TO RELATED APPLICATIONS

The present application claims priority to Korean Patent Application No. 10-2013-122376, filed on Oct. 15, 2013, the entire contents of which is incorporated herein for all purposes by this reference.

BACKGROUND OF THE INVENTION

1. Field of the Invention

The present invention relates to a structure of an exhaust system for a vehicle, and more particularly, to a structure of an exhaust system for a cylinder deactivation (CDA) engine, in which a main muffler is divided into four spaces by three baffles, and a connecting pipe which connects a second space and a third space, a first valve which is coupled to a passage of the connecting pipe, and a second valve which is coupled to the baffle that is disposed between the second space and the third space are provided, thereby reducing noise in the exhaust system with maximum efficiency in accordance with characteristics of an engine.

2. Description of Related Art

Recently, in respect to increased concerns about the environment, major issues such as an environmental problem with excessive emission of exhaust gas of a vehicle and consumers preferring a high efficiency vehicle because of an increase in cost of crude oil have become the focus.

Therefore, various technologies are being developed in order to improve fuel efficiency of a vehicle, and increase output of an engine.

For example, a variable induction system (VIS) which changes a length or a cross-sectional area of an intake manifold in accordance with air intake resistance that is varied depending on a rotational region of an engine, a variable valve timing (VVT) which adjusts an opening timing and an opening degree of a valve depending on a rotational region of an engine, a variable valve lift (VVL) which adjusts a lifting height of a valve, and a cylinder deactivation (CDA) which switches some cylinders in an engine to a non-operational state/a full operational state in accordance with a traveling state in order to improve fuel efficiency have been developed and used.

Among the aforementioned technologies, the CDA engine refers to an engine that deactivates some of the cylinders when braking the vehicle or when the vehicle travels at a constant speed, and fuel supply and operations of intake/exhaust valves are stopped at the deactivated cylinder side.

Because maximum output of the engine of the vehicle is required only when the vehicle accelerates or travels up a slope, fuel consumption may be reduced by not selectively igniting fuel in the cylinder in a case in which the vehicle may be operated by merely using partial output of the engine.

For example, in the case of the vehicle in which a four-cylinder engine is mounted, because there is no reason to operate all of the cylinders to generate power when braking the vehicle in a traveling state, or when the vehicle is in a low idle condition or a low load condition, two cylinders are deactivated, and power is generated only by the remaining two cylinders.

However, the CDA engine has advantages in that fuel consumption is low and fuel efficiency is high in comparison with a typical engine, but has problems in that because fuel in some of the cylinders is not ignited, the main component of engine noise is changed and low frequency noise is increased.

In order to solve the aforementioned problems, in a structure of an exhaust system for a CDA engine in the related art, as illustrated in FIG. 1, an additional muffler 2 is mounted in an exhaust pipe 4, which connects a sub muffler 1 and a main muffler 3, so that the entire exhaust pipe 4 is divided into several segments, thereby reducing noise.

That is, in the CDA mode in which only two cylinders of the four-cylinder engine is operated, a half order low frequency noise component (a noise component that corresponds to C1, C3, and the like among main components of engine noise), which is hardly generated in a general mode, is additionally generated, and combined with a low frequency resonance mode in the existing exhaust pipe, and as a result, there is a problem in that noise characteristics of the vehicle deteriorates.

Therefore, as illustrated in FIG. 2, the additional muffler 2 is mounted at peak points of a second resonance mode of the exhaust system and a fourth resonance mode of the exhaust system to reduce a resonance mode of the exhaust system.

However, in the case of the structure of the exhaust system for a CDA engine in the related art in which a separate additional muffler is mounted, there are still problems in that spaces for other components (a fuel tank, a rear suspension, an interior space, and the like) need to be decreased in order to mount the additional muffler between the sub muffler and the main muffler, and a weight of the vehicle is excessively increased because of the additional muffler.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a structure of an exhaust system for a CDA engine, in which a main muffler is divided into four spaces, and connecting pipes and valves, which connect the respective spaces, are provided, thereby solving a problem with resonance in an exhaust pipe due to an application of a CDA mode without mounting a separate additional muffler.

In an aspect of the present invention, a structure of an exhaust system for a cylinder deactivation (CDA) engine, which may include a first exhaust pipe which may be connected with a sub muffler connected with an exhaust pipe of a vehicle, and through which exhaust gas passes, a main muffler which may be connected to the first exhaust pipe, and reduces noise generated by the exhaust gas, and a second exhaust pipe which may be connected to the main muffler, and through which the exhaust gas passing through the main muffler passes, may may include first, second and third baffles which may be coupled in the main muffler in a lateral direction thereof, and divide an interior of the main muffler into first, second, third and fourth spaces respectively, a connecting pipe which may be disposed outside the main muffler, connects the second space and the third space of the main muffler, and may have a passage in which the exhaust gas flows, a first valve which may be coupled to the passage of the connecting pipe to open and close the passage of the connecting pipe, and a second valve which may be openably and closably coupled to the second baffle that may be disposed between the second space and the third space, wherein the first baffle, which may be coupled between the first space and the second space, and the third baffle, which may be coupled between the third space and the fourth space, may have an aperture or a plurality of holes so that the exhaust gas flows therethrough.

The second valve may include an annular housing which may be coupled to the second baffle, which may be disposed between the second space and the third space of the main muffler, and may have an opening portion therein, a valve cover which may be rotatably connected to a hinge coupled to one side of the housing, and a compressive spring which may be disposed between the housing and the valve cover, and allows the valve cover to be opened only when pressure of the exhaust gas may be a predetermined lever or more, wherein an active valve, which may be operated by a motor, may be applied as the first valve.

When the engine of the vehicle may be in a general mode, the second valve may be opened, and the first valve may be closed, such that the exhaust gas in the main muffler flows only through the second valve.

When the engine of the vehicle may be in a CDA mode, the first valve may be opened, and the second valve may be closed, such that the exhaust gas in the main muffler flows only through the connecting pipe.

An end of the first exhaust pipe may be mounted in the first space by passing through the fourth, third and second spaces sequentially.

An end of the second exhaust pipe may be mounted in the fourth space by passing through the first, second and second spaces sequentially.

The present invention having the aforementioned configuration includes the three baffles which are coupled in the main muffler in a lateral direction, the connecting pipe which connects the second space and the third space, the first valve which is coupled to the passage of the connecting pipe, and the second valve which is coupled to the baffle that is disposed between the second space and the third space, thereby solving a problem with resonance in an exhaust pipe due to an application of a CDA mode while maintaining a structure of the existing exhaust system.

That is, when the engine of the vehicle is in the CDA mode, the first valve is opened, and the second valve is closed, such that the exhaust gas in the main muffler flows only through the connecting pipe, and as a result, positions of the first muffler and the second muffler are far away from each other, thereby increasing a length of the entire exhaust system, and achieving the effect that is obtained when another muffler is further added.

When the engine of the vehicle is in a general mode, the second valve is opened, and the first valve is closed, such that the exhaust gas in the main muffler flows only through the second valve, thereby reducing overall back pressure by shortening a flow path of the exhaust gas.

By actively utilizing a structure of the existing exhaust system, it is possible to minimize a decrease in space for the other components (a fuel tank, a rear suspension, an interior space, and the like) and an increase in weight of the vehicle, which are caused by mounting an additional muffler.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
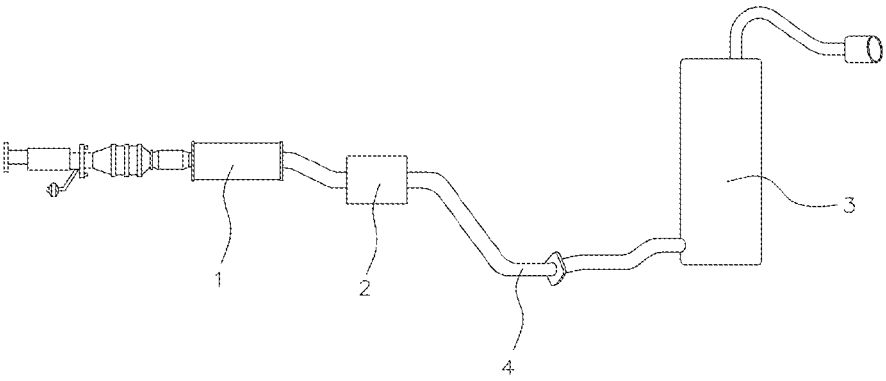
FIG. 1 (Prior Art)
FIG. 1 is a top plan view illustrating an appearance in which an additional muffler is mounted in a structure of an exhaust system for a CDA engine in the related art.
Figure 2:
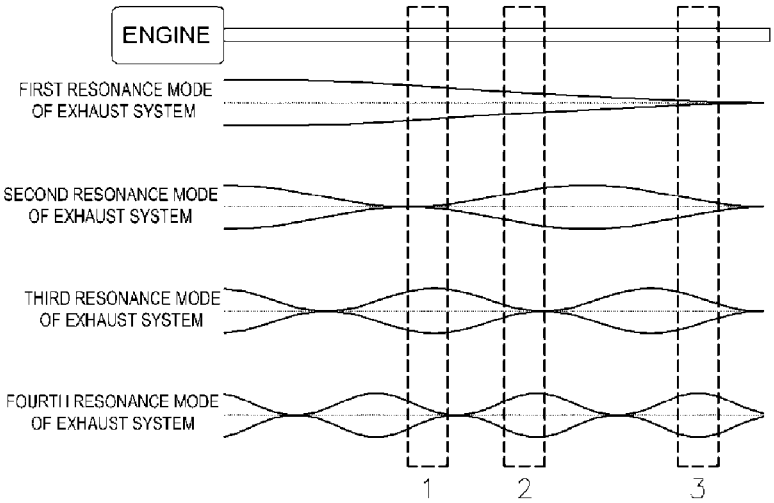
FIG. 2 (Prior Art)
FIG. 2 is an exemplified view schematically illustrating resonance modes of the exhaust system and positions of the muffler in the structure of the exhaust system for a CDA engine in the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, the present invention will be described in detail with reference to the accompanying drawings.

A structure of an exhaust system for a cylinder deactivation (CDA) engine according to an exemplary embodiment of the present invention includes, a first exhaust pipe 12 which is connected with a sub muffler 10 connected with an exhaust pipe of a vehicle, and through which exhaust gas passes; a main muffler 20 which is connected to the first exhaust pipe 12, and reduces noise generated by the exhaust gas; and. a second exhaust pipe 14 which is connected to the main muffler 20, and through which the exhaust gas passing through the main muffler 20 passes, and the structure of the exhaust system for a CDA engine includes, three baffles 30 which are coupled in the main muffler 20 in a lateral direction, and divide the interior of the main muffler 20 into a first space 22 to a fourth space 28; a connecting pipe 40 which is disposed outside the main muffler 20, connects the second space 24 and the third space 26 of the main muffler 20, and has a passage in which the exhaust gas flows; a first valve 42 which is coupled to the passage of the connecting pipe 40 to open and close the passage of the connecting pipe 40; and. a second valve 50 which is openably and closably coupled to the baffle 30 that is disposed between the second space 24 and the third space 26, in which the baffle 30, which is coupled between the first space 22 and the second space 24, and the baffle 30, which is coupled between the third space 26 and the fourth space 28, have an aperture or a plurality of holes so that the exhaust gas may flow therethrough.

Figure 3:
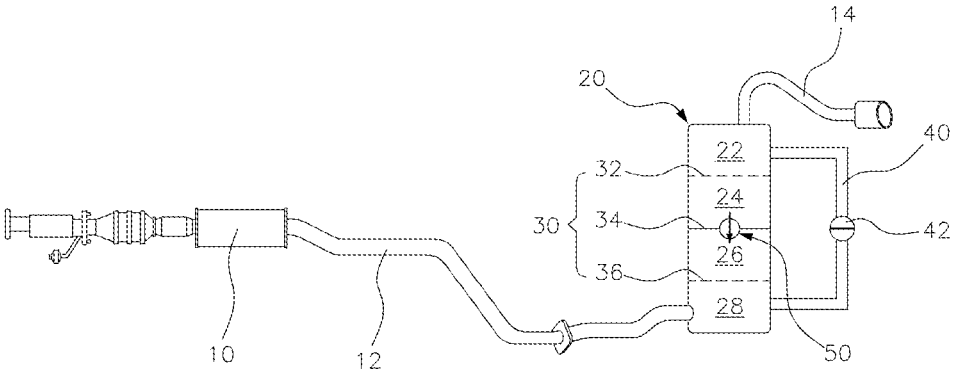
FIG. 3 is a top plan view illustrating an appearance of a structure of an exhaust system for a CDA engine according to an exemplary embodiment of the present invention.

As illustrated in FIG. 3, the sub muffler 10 is connected with an exhaust pipe of the vehicle, and serves to primarily reduce noise generated by the exhaust gas discharged from the exhaust pipe.

The first exhaust pipe 12 is connected to a rear side of the sub muffler 10 to supply the exhaust gas to the main muffler 20, and noise generated by the exhaust gas is secondarily reduced by the main muffler 20 connected to the first pipe.

The second exhaust pipe 14 is connected to a rear side of the main muffler 20, and the second exhaust pipe 14 serves to discharge the exhaust gas discharged from the main muffler 20 to the outside of the vehicle.

Figure 6:
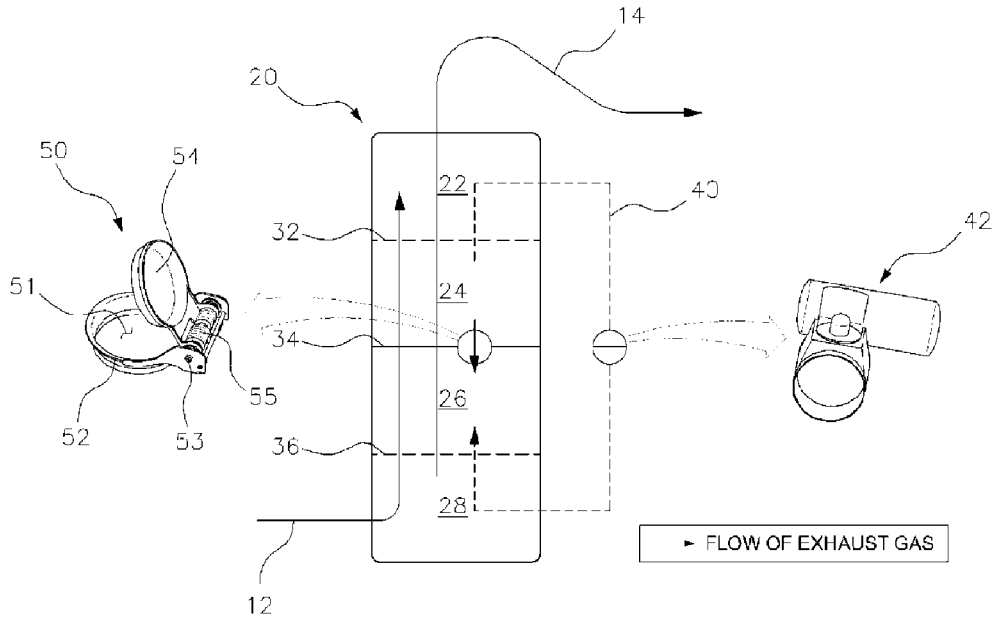
FIG. 6 is an exemplified view illustrating a case in which an engine of a vehicle is in a general mode in the structure of the exhaust system for a CDA engine according to the exemplary embodiment of the present invention.

As illustrated in FIG. 6, the first exhaust pipe 12 is extended from the sub muffler 10 to the first space 22 of the main muffler 20, which will be described below, and allows the exhaust gas passing through the sub muffler 10 to be supplied to the first space 22 of the main muffler 20.

The second exhaust pipe 14 is extended from the fourth space 28 of the main muffler 20, which will be described below, to the outside of the vehicle, and allows the exhaust gas passing through the interior of the main muffler 20 to be discharged to the outside of the vehicle.

As illustrated in FIG. 3, the three baffles 30 are coupled in the main muffler 20 in the lateral direction to divide the interior of the main muffler 20 into the first space 22 to the fourth space 28, and in the illustrated exemplary embodiment, the space, which is positioned at an uppermost end, is the first space 22, the space, which is positioned immediately below the first space 22, is the second space 24, the space, which is positioned immediately below the second space 24, is the third space 26, and the space, which is positioned at a lowermost end, is the fourth space 28.

In the illustrated exemplary embodiment, the baffle 30 includes a first baffle 32 that is disposed between the first space 22 and the second space 24, a second baffle 34 that is disposed between the second space 24 and the third space 26, and a third baffle 36 that is disposed between the third space 26 and the fourth space 28.

The first baffle 32 and the third baffle 36 have an aperture or a plurality holes so that the exhaust gas may freely flow therethrough, and the second baffle 34 is formed in a blocked plate shape, which has no aperture or holes, so that the exhaust gas flows only through the second valve 50 that will be described below.

In the illustrated exemplary embodiment, the first baffle 32 and the third baffle 36 have the aperture or the plurality of holes so that the exhaust gas flows therethrough, but the first baffle 32 and the third baffle 36 may include other structures such as a plurality of short pipes and a permeable membrane that may allow the exhaust gas to flow therethrough.

As illustrated in FIG. 3, the connecting pipe 40 is coupled outside the main muffler 20, and specifically, the connecting pipe 40 connects the second space 24 and the third space 26 of the main muffler 20.

As illustrated in FIG. 6, the connecting pipe 40 is formed as a long pipe having an overall '⊏' shape which has an inlet and an outlet that are curved in directions toward the second space 24 and the third space 26, respectively.

Of course, the connecting pipe 40 may be formed in various shapes such as a 'U' shape depending on a shape of the main muffler 20, utilization of an overall space in the exhaust system, and the type of vehicle.

As illustrated in FIG. 3, the first valve 42 is installed in the passage of the connecting pipe 40, and the second valve 50 is installed in the second baffle 34, thereby shutting off or permitting the flow of the exhaust gas that flows through the connecting pipe 40 or the second baffle 34.

The first valve 42 and the second valve 50 have general valve covers formed in a circular plate, and open or close the connecting pipe 40 and the second baffle 34 by being controlled by a control unit depending on whether the CDA engine is operated.

The illustrated exemplary embodiment shows a case in which the CDA mode is not operated (that is, operated in a general mode), and shows a state in which the first valve 42 is laterally disposed to close the connecting pipe 40, and the second valve 50 is longitudinally disposed to open the second baffle 34.

Figure 4:
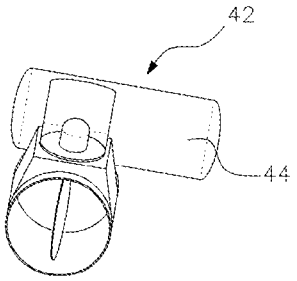
FIG. 4 is a perspective view illustrating an active valve that is applied as a first valve in the structure of the exhaust system for a CDA engine according to the exemplary embodiment of the present invention.
Figure 5:
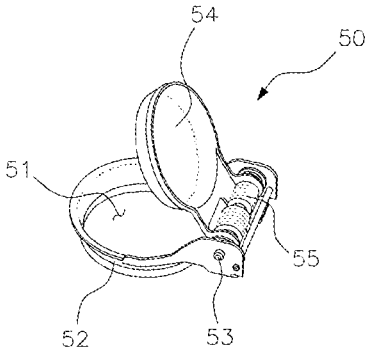
FIG. 5 is a perspective view illustrating a semi-active valve that is applied as a second valve in the structure of the exhaust system for a CDA engine according to the exemplary embodiment of the present invention.

As illustrated in FIGS. 4 and 5, the first valve 42 may be an active valve that is operated by a motor 44, and the second valve 50 may be a semi-active valve that is operated by pressure of the exhaust gas in the second space 24 and the third space 26 of the main muffler 20.

That is, when the first valve 42 is operated by the motor 44 and opens the connecting pipe 40, the exhaust gas flows through the connecting pipe 40, and the second valve 50 is closed, and when the first valve 42 closes the connecting pipe 40, pressure of the exhaust gas in the second space 24 becomes greater than pressure of the exhaust gas in the third space 26, such that the second valve 50 is opened.

As illustrated in FIG. 5, as the second valve 50, a semi-active valve, which includes a housing 52, a valve cover 54, and a compressive spring 55, may be applied.

The housing 52 has an opening portion 51 formed therein, and an annular rim, is mounted in the second baffle 34, and has holes formed at one side, and a hinge 53 having a pin shape is coupled between the holes.

Figure 8:
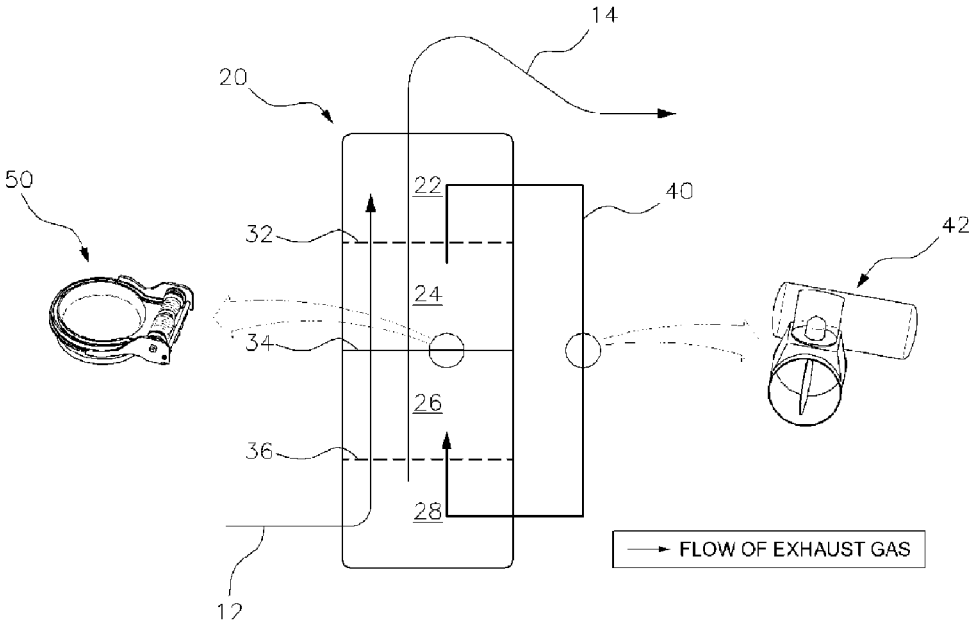
FIG. 8 is an exemplified view illustrating a case in which the engine of the vehicle is in a CDA mode in the structure of the exhaust system for a CDA engine according to the exemplary embodiment of the present invention.

The valve cover 54 having a circular plate shape is connected to the hinge 53, and the compressive spring 55 is disposed between the valve cover 54 and the housing 52, such that the second valve 50 may be closed by elastic force of the compressive spring 55, as illustrated in FIG. 8.

An outer diameter of the valve cover 54 matches an inner diameter of the housing 52, such that when the second valve 50 is closed, the flow of the exhaust gas in the main muffler 20 may be completely shut off.

FIG. 6 illustrates a structure in which the valve cover 54 of the second valve 50 is disposed in a direction toward the second space 24 of the main muffler 20, but this illustration is merely for the purpose of showing the configuration of the second valve 50 well, and in the exemplary embodiment, the second valve 50 is coupled to the second baffle 34 while forming a structure in which the valve cover 54 is disposed in a direction toward the third space 26 of the main muffler 20, that is, a structure that is made by reversing the top and bottom of the structure illustrated in FIG. 6.

As illustrated in FIG. 6, when pressure of the exhaust gas in the second space 24 of the main muffler 20 becomes greater than pressure of the exhaust gas in the third space 26 as the first valve 42 is closed, the valve cover 54 of the second valve 50 is opened while overcoming elastic force of the compressive spring 55, and when the first valve 42 is opened as illustrated in FIG. 8, the valve cover 54 of the second valve 50 comes into close contact with the housing 52 and then is closed by elastic force of the compressive spring 55.

An operational process and an operational effect of the structure of the exhaust system for a CDA engine according to the exemplary embodiment of the present invention will be described below.

As illustrated in FIG. 6, when the CDA mode is not operated, that is, when the engine of the vehicle is in the general mode, the exhaust gas is first supplied to the first space 22 in the main muffler 20 through the first exhaust pipe 12.

Next, the exhaust gas supplied to the first space 22 flows to the second space 24 through the aperture or the plurality of holes formed in the first baffle 32, and flows to the third space 26 through the opened second valve 50.

The exhaust gas flowing to the third space 26 flows to the fourth space 28 through the aperture or the plurality of holes of the third baffle 36, and is discharged to the outside of the main muffler 20 through the second exhaust pipe 14 connected to the fourth space 28.

In addition, when the engine of the vehicle is in the general mode, only a main order component (a noise component that corresponds to C2, C4, and the like among main components of engine noise) of engine noise is mainly generated, and as a result, the possibility that the main order component is combined with a low frequency resonance mode of the exhaust pipe is relatively low.

Figure 7A:
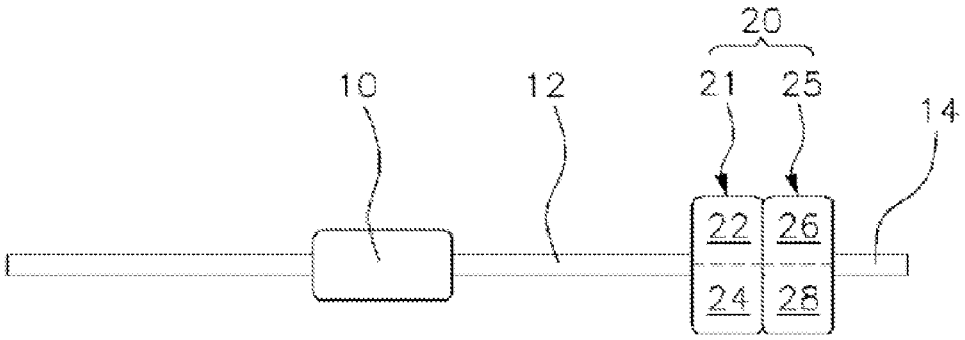
FIG. 7A and FIG. 7B are exemplified views schematically illustrating resonance modes of the exhaust system and positions of a muffler in the case in which the engine of the vehicle is in the general mode in the structure of the exhaust system for a CDA engine according to the exemplary embodiment of the present invention.
Figure 7B:
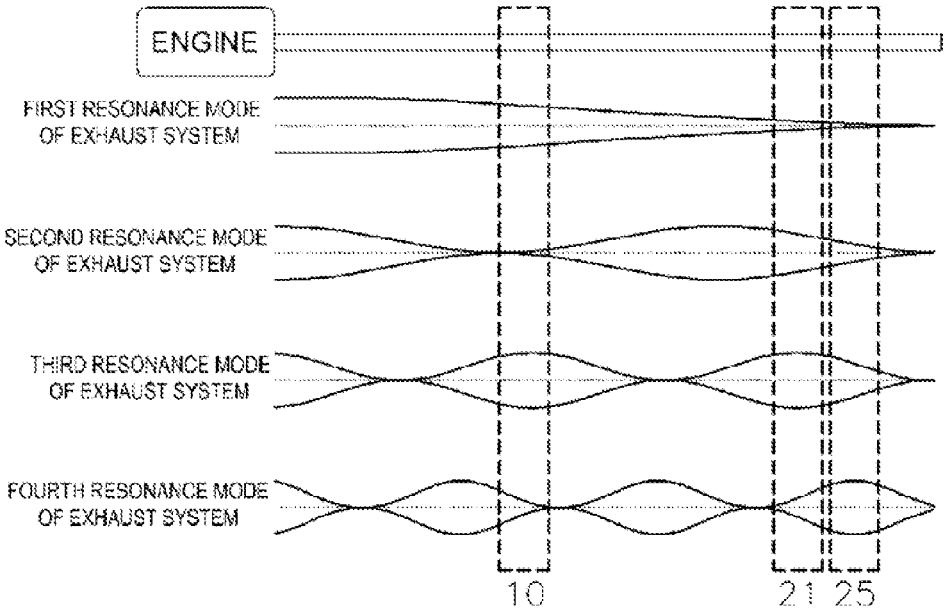

Therefore, as illustrated in FIGS. 7A and 7B, when the engine of the vehicle is in the general mode, a first muffler 21 including the first space 22 and the second space 24 of the main muffler 20 is disposed to be adjacent to a second muffler 25 including the third space 26 and the fourth space 28 of the main muffler 20, and serves to reduce back pressure throughout the entire exhaust system.

That is, when the engine of the vehicle is in the general mode, only the second valve 50, which is a relatively short flow path, is opened, and the first muffler 21 is disposed to be adjacent to the second muffler 25, and as a result, an effect of reducing back pressure throughout the exhaust system is produced.

As illustrated in FIG. 8, likewise, even when the CDA mode is operated, the exhaust gas is first supplied to the first space 22 in the main muffler 20 through the first exhaust pipe 12, and flows to the second space 24 through the aperture or the plurality of holes of the first baffle 32.

Next, the exhaust gas flowing to the second space 24 flows to the third space 26 through the connecting pipe 40, flows to the fourth space 28 through the aperture or the plurality of holes of the third baffle 36, and is discharged to the outside of the main muffler 20 through the second exhaust pipe 14 connected to the fourth space 28.

When the engine of the vehicle is in the CDA mode, a half order component (a noise component that corresponds to C1, C3, and the like among main components of the engine noise) of the engine noise is additionally generated, and combined with the low frequency resonance mode of the exhaust pipe, which causes noise characteristics of the vehicle to deteriorate.

Figure 9A:
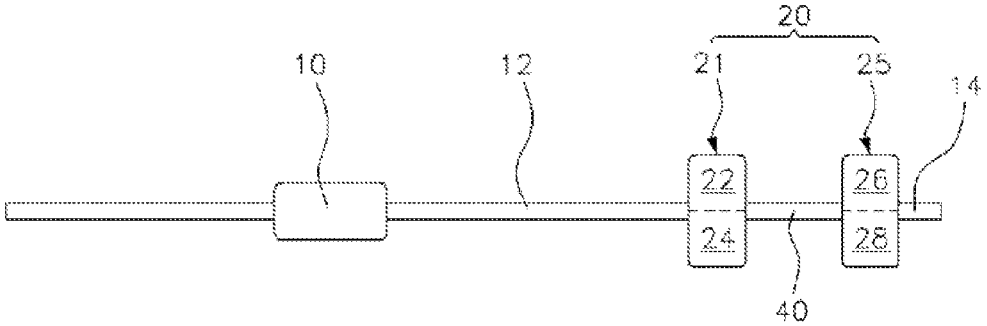
FIG. 9A and FIG. 9B are exemplified views schematically illustrating resonance modes of the exhaust system and positions of the muffler in the case in which the engine of the vehicle is in the CDA mode in the structure of the exhaust system for a CDA engine according to the exemplary embodiment of the present invention.
Figure 9B:
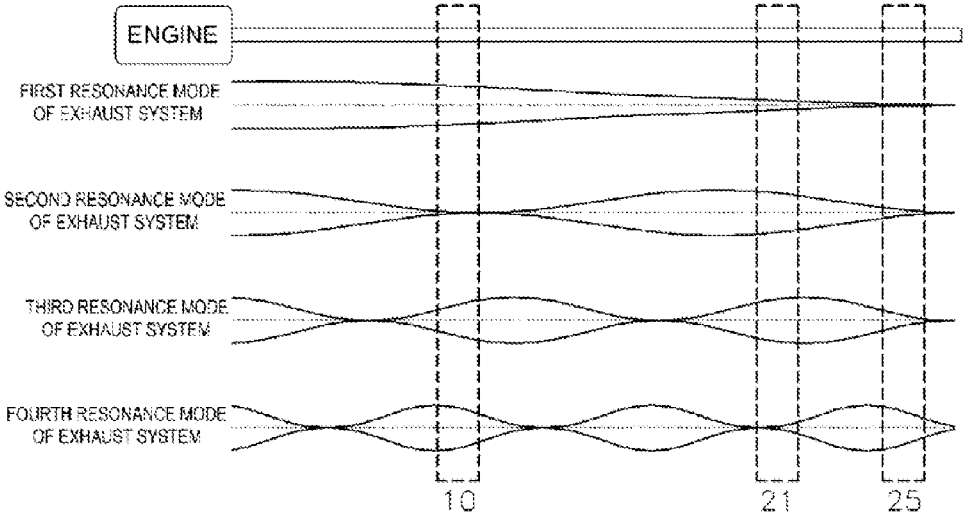

Therefore, as illustrated in FIGS. 9A and 9B, when the engine of the vehicle is in the CDA mode, the main muffler 20 is separated into the first muffler 21 and the second muffler 25 by the connecting pipe 40, and the first muffler 21 is disposed to be adjacent to a peak point of a second resonance mode of the exhaust system, thereby reducing resonance in the exhaust pipe.

As a distance between the first muffler 21 and the second muffler 25 becomes longer, a length of the structure of the entire exhaust system becomes longer, and the sub muffler 10 becomes relatively closer to a peak point of a first resonance mode of the exhaust system.

That is, when the engine of the vehicle is in the CDA mode, only the connecting pipe 40, which is a relatively long flow path, is opened, and the first muffler 21 and the second muffler 25 are separated, thereby achieving the effect that is obtained when another muffler is further added.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A structure of an exhaust system for a cylinder deactivation (CDA) engine, which includes a first exhaust pipe which is connected with a sub muffler connected with an exhaust pipe of a vehicle, and through which exhaust gas passes, a main muffler which is connected to the first exhaust pipe, and reduces noise generated by the exhaust gas, and a second exhaust pipe which is connected to the main muffler, and through which the exhaust gas passing through the main muffler passes, the structure comprising:

first, second and third baffles which are coupled in the main muffler in a lateral direction thereof, and divide an interior of the main muffler into first, second, third and fourth spaces respectively;

a connecting pipe which is disposed outside the main muffler, connects the second space and the third space of the main muffler, and has a passage in which the exhaust gas flows;

a first valve which is coupled to the passage of the connecting pipe to open and close the passage of the connecting pipe; and a second valve which is openably and closably coupled to the second baffle that is disposed between the second space and the third space, wherein the first baffle, which is coupled between the first space and the second space, and the third baffle, which is coupled between the third space and the fourth space, have an aperture or a plurality of holes so that the exhaust gas flows therethrough.

2. The structure of claim 1, wherein the second valve includes:

an annular housing which is coupled to the second baffle, which is disposed between the second space and the third space of the main muffler, and has an opening portion therein;

a valve cover which is rotatably connected to a hinge coupled to one side of the housing; and a compressive spring which is disposed between the housing and the valve cover, and allows the valve cover to be opened only when pressure of the exhaust gas is a predetermined lever or more, wherein an active valve, which is operated by a motor, is applied as the first valve.

3. The structure of claim 1, wherein when the engine of the vehicle is in a general mode, the second valve is opened, and the first valve is closed, such that the exhaust gas in the main muffler flows only through the second valve.

4. The structure of claim 1, wherein when the engine of the vehicle is in a CDA mode, the first valve is opened, and the second valve is closed, such that the exhaust gas in the main muffler flows only through the connecting pipe.

5. The structure of claim 1, wherein an end of the first exhaust pipe is mounted in the first space by passing through the fourth, third and second spaces sequentially.

6. The structure of claim 1, wherein an end of the second exhaust pipe is mounted in the fourth space by passing through the first, second and second spaces sequentially.

* * * * *